US006388184B1

(12) United States Patent
Glenning

(10) Patent No.: US 6,388,184 B1
(45) Date of Patent: May 14, 2002

(54) DEPLOYABLE NOSE FOR AN UNDERWATER VEHICLE

(75) Inventor: Daniel M. Glenning, Middletown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 42 days.

(21) Appl. No.: 09/678,878

(22) Filed: Oct. 4, 2000

(51) Int. Cl.[7] ..... F42B 19/00

(52) U.S. Cl. ..... 114/22; 89/1.809; 102/399; 244/3.1; 114/20.1

(58) Field of Search ..... 114/67 R, 20.1, 114/22; 102/399, 401, 404, 406; 244/158 A, 219, 49, 130, 120, 3.1

(56) References Cited

U.S. PATENT DOCUMENTS 4,304,186 A * 12/1981 Fischer et al. ..... 102/401
4,368,671 A * 1/1983 Weber et al. ..... 102/401
4,549,464 A * 10/1985 Hawkins et al. ..... 102/293
4,569,300 A * 2/1986 Ferris et al. ..... 114/20.1
4,579,058 A * 4/1986 Alker ..... 102/401
4,770,369 A * 9/1988 Flock et al. ..... 102/293
4,921,557 A * 5/1990 Nakamura ..... 156/169
5,463,957 A * 11/1995 Jensen et al. ..... 102/293

FOREIGN PATENT DOCUMENTS

DE 3920818 A1 * 5/1990 ..... F42B/12/10

* cited by examiner

*Primary Examiner*—Michael J. Carone
*Assistant Examiner*—Denise J Buckley
(74) *Attorney, Agent, or Firm*—Michael J. McGowan; James M. Kasischke; Prithvi C. Lall

(57) ABSTRACT

A deployable nose is used on an underwater vehicle to provide a shorter length when in a retracted position and to provide a reduced drag when in the deployed position. The deployable nose includes a plurality of nose sections and a deployment mechanism that moves the plurality of nose sections from the retracted position to the deployed position. The nose sections include a base nose section attached at the end of the underwater vehicle, an outer nose section having a rounded contour, and one or more intermediate nose sections between the base nose section and outer nose section. In the retracted position, the outer nose section and one or more intermediate nose sections are retracted generally within the base nose section. In the deployed position, the outer nose section and intermediate nose sections extend outwardly from the base nose section and interlock proximate the edges of the nose sections to form the deployed nose.

16 Claims, 2 Drawing Sheets

DEPLOYABLE NOSE FOR AN UNDERWATER VEHICLE

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates to underwater vehicles, and more particularly, to a deployable nose for use with an underwater vehicle.

(2) Description of the Prior Art

Underwater vehicles, such as torpedoes, are commonly stored in submarines or other such vessels. In submarines, the limited space available in the storage rack and torpedo tubes dictate the maximum length of the underwater vehicle. To comply with the space requirements, the axial length of the nose of the underwater vehicle is often shortened resulting in a flat nose contour. As a result of these constraints placed upon the nose contour, the optimum hydrodynamic contour design is compromised, and the form drag of the underwater vehicle is significantly increased. The excess form drag requires additional power to run at a specific speed and also limits the range of the underwater vehicle for a given amount of stored energy, thereby reducing the range of the vehicle.

SUMMARY OF THE INVENTION

Accordingly, a first object of the present invention is to provide a nose contour capable of meeting the tight length constraints imposed by existing submarines.

Another object is to minimize the form drag of the underwater vehicle.

The present invention features a deployable nose for use on an underwater vehicle. The deployable nose comprises a plurality of nose sections disposed at one end of the underwater vehicle and a deployment mechanism coupled to at least one of the nose sections. The deployment mechanism moves the nose sections from a retracted position where the nose sections occupy less space toward the underwater vehicle to a deployed position where the nose sections extend outwardly from the underwater vehicle to form a generally rounded nose contour.

The nose sections preferably include a base nose section disposed at the one end of the underwater vehicle, an outer nose section having a generally rounded contour, and at least one intermediate nose section having a tapered ring shape and disposed between the outer nose section and the base nose section. The deployment mechanism is housed within the base nose section and moves the outer nose section from the retracted position where the outer nose section and the intermediate nose section are retracted into the base nose section to a deployed position where the intermediate nose section and the outer nose section fit together and extend outwardly from the base nose section. In one example, first and second intermediate nose sections interlock with the base nose section and outer nose section, respectively. The deployment mechanism includes a threaded shaft, a block threadably disposed on the shaft, at least one arm coupled to an inner region of at least one of the nose sections and coupled to the block, and a motor coupled to the shaft for rotating the shaft. When the shaft is rotated, the block moves along the shaft and causes the arm to move the nose sections.

The present invention also features an underwater vehicle comprising a body portion, a deployable nose at one end of the body portion, and a deployment mechanism for moving the deployable nose from a retracted position to a deployed position. The underwater vehicle has a shorter length when the deployable nose is in the retracted position and has reduced drag when the deployable nose is in the deployed position.

BRIEF DESCRIPTION OF THE DRAWINGS

These and other features and advantages of the present invention will be better understood in view of the following description of the invention taken together with the drawings wherein.

DESCRIPTION OF THE PREFERRED EMBODIMENT

Figure 2:
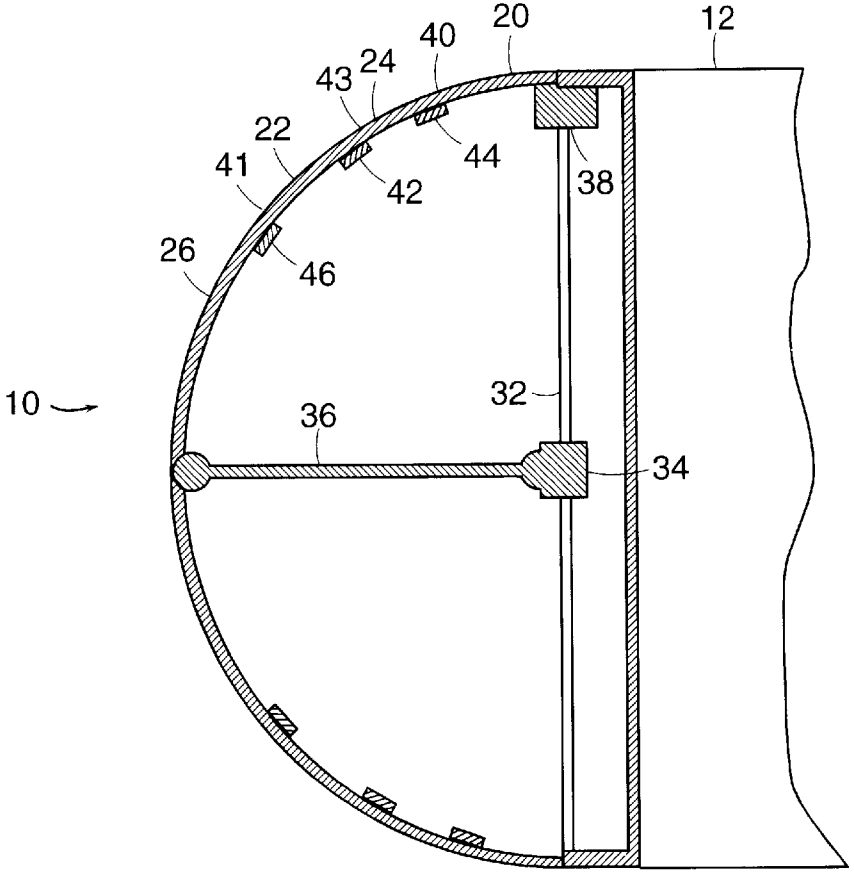
FIG. 2 is a cross-sectional schematic view of the deployable nose in a deployed position, according to the present invention.
Figure 1:
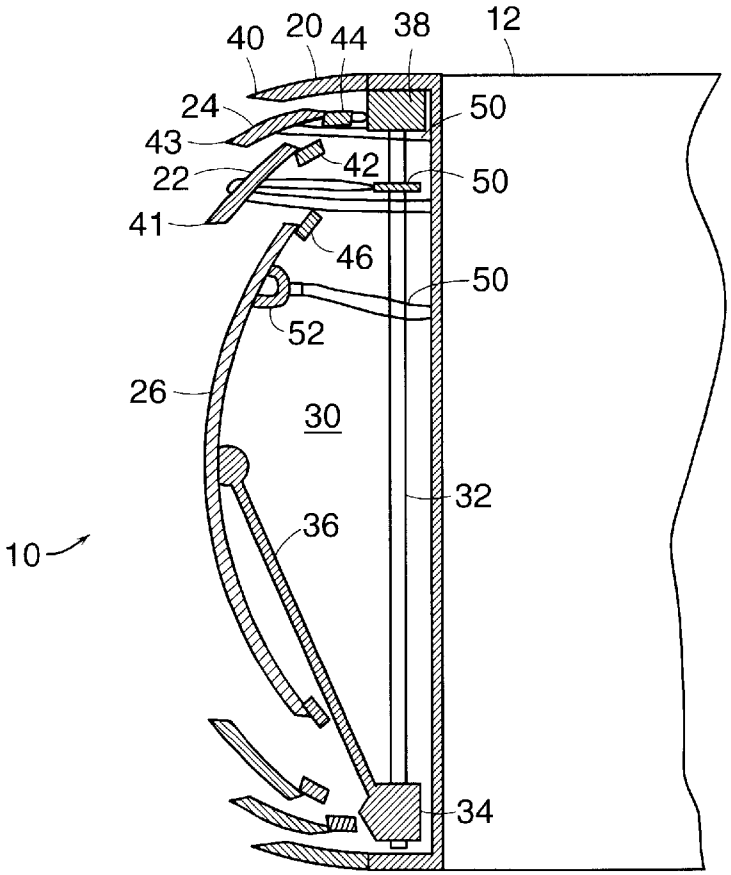
FIG. 1 is a cross-sectional schematic view of a deployable nose in a retracted position, according to the present invention.

A deployable nose 10, FIGS. 1 and 2, according to the present invention, is disposed at the end of an underwater vehicle 12. When the deployable nose 10 is in a retracted position (FIG. 1), the length of the underwater vehicle 10 is shorter allowing the underwater vehicle to fit within the constrained storage space on a submarine or other vessel (not shown). When the deployable nose 10 is in the deployed position (FIG. 2), the hydrodynamic contour of the nose 10 reduces the form drag on the vehicle 12, thereby minimizing the power required to run at a specific speed and increasing the range of the vehicle 12 for a given amount of stored energy. Although the exemplary embodiment refers to an underwater vehicle 12, such as a torpedo, the deployable nose 10 of the present invention can also be used with other types of vehicles.

The deployable nose 10 includes a plurality of nose sections 20, 22, 24, 26 having a generally telescoping arrangement and a deployment mechanism 30 coupled to at least one of the nose sections 22, 24, 26 for moving the nose sections 22, 24, 26 between the retracted and deployed positions. A base nose section 20 is attached to the end of the underwater vehicle 12 and forms the base of the deployed nose. An outer nose section 26 having a generally rounded contour is centrally located and forms the outer portion of the deployed nose 10. First and second intermediate nose sections 22, 24 having a generally tapered ring shape are disposed between the base nose section 20 and outer nose section 26 to form an intermediate portion of the deployed nose 10. The nose sections 20–26 can be made of any material suitable for use on an underwater vehicle. Although the exemplary embodiment uses two intermediate nose sections 22, 24, any number of intermediate nose sections can be used depending upon the size of the underwater vehicle.

In one embodiment, the deployment mechanism 30 includes a threaded shaft 32 extending transversely across the base nose section 20. An internally threaded block 34 is disposed on the threaded shaft 32 and travels along the shaft 32 when the shaft 32 is rotated. An arm 36 is pivotably coupled to the block 34 and to an inner region of the outer nose section 26. A motor 38, such as an electric or hydraulic motor, rotates the threaded shaft 32 to cause the block 34 to move along the shaft 32 which causes the arm 36 to move inwardly or outwardly. Other deployment mechanisms capable of moving the nose sections 22, 24, 26 can also be used.

The nose sections 20–26 have interlocking edges that are adapted to interlock with mating interlocking edges on an adjacent nose section when the nose 10 is deployed. The base nose section has an interlocking edge 40. The first intermediate nose section 22 has first and second interlocking edges 41, 42 and the second intermediate nose section 24 has first and second interlocking edges 43, 44. The outer nose section 26 has an interlocking edge 46. The first interlocking edge 41 of first intermediate nose section 22 has a smaller diameter than the interlocking edge 46 of the outer nose section 26. Likewise, the first interlocking edge 43 of the second intermediate nose section 24 has a smaller diameter than the second interlocking edge 42 of the first intermediate nose section 22. The interlocking edge 40 of the base nose section 20 has a smaller diameter than the second interlocking edge 44 of the second intermediate nose section 24. This prevents an inner forward section from falling through an outer aft section.

In operation, the deployment mechanism 30 changes the nose contour after the underwater vehicle is launched from the submarine by moving the nose 10 from the retracted position (FIG. 1) to the deployed position (FIG. 2). In the retracted position (FIG. 1), the outer nose section 26 and intermediate nose sections 22f 24 are preferably retracted inwardly generally within the base nose section 20, allowing the vehicle 12 to fit in the limited space on a submarine or other vessel. When the motor 38 rotates the shaft 32 to move the block 34 toward the center of the shaft 32, the arm 36 moves the outer nose section 26 outwardly.

When the outer nose section 26 moves outwardly, the interlocking edge 46 of the outer nose section 26 engages and interlocks with the first interlocking edge 41 of the first intermediate nose section 22, causing the first intermediate nose section 22 to move outwardly. The second interlocking edge 42 of the first intermediate nose section 22 then engages and interlocks with the first interlocking edge 43 of the second intermediate nose section 24, causing the second intermediate nose section 24 to move outwardly. The second interlocking edge 44 of the second intermediate nose section 24 then engages and interlocks with the interlocking edge 40 of the base nose section 20. In the deployed position (FIG. 2), the outer nose section 26 and intermediate nose sections 22, 24 extend outwardly from the base nose section 20 to form the rounded outer nose contour.

Optionally, a plurality of retaining means 50 can be provided between movable nose sections 22, 24, and 26 to prevent the sections from sliding prior to deployment. Retaining means 50 can be VELCRO strips joined to undersea vehicle 12 and wrapped around nose sections 22, 24, 26 or a retaining portion 52 positioned on a nose section 26. Tie wraps or another well known break away fastening means can also be used.

Figure 3:
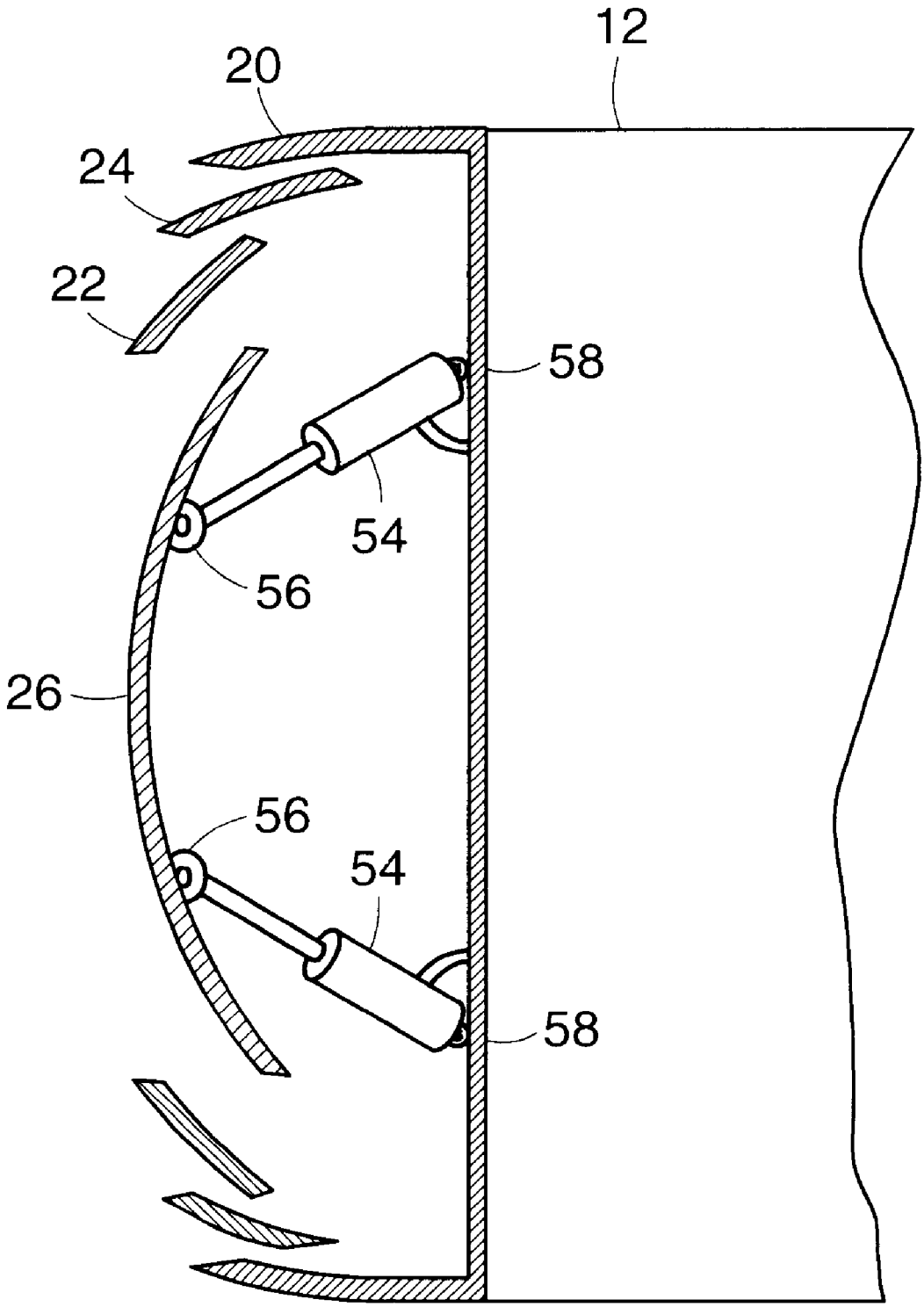
FIG. 3 is a cross-sectional schematic of an alternate embodiment of a deployable nose in a retracted position.

An alternate embodiment, shown in FIG. 3, utilizes a plurality of linear actuators 54 such as hydraulic, electrical or pneumatic actuators joined to pivot 56 at outer nose section 26 and pivot 58 at vehicle 12. As the actuators 54 are extended, each end of the actuators 54 pivots, increasing the distance between nose section 26 and vehicle 12. As above, outer nose section 26 contacts and extends first intermediate nose section 22 which contacts and extends second intermediate nose section 24.

Accordingly, the deployable nose of the present invention is capable of meeting the tight length constraints imposed by existing submarines without having to accept a high form drag on the vehicle 12.

In light of the above, it is therefore understood that within the scope of the appended claims, the invention may be practiced otherwise than as specifically described.

What is claimed is:

1. A deployable nose for use on an underwater vehicle, said deployable nose comprising:

a plurality of nose sections including interlocking edges disposed at one end of said underwater vehicle; and a deployment mechanism disposed at said one end of said underwater vehicle and coupled to at least one of said plurality of nose sections for moving said plurality of nose sections from a retracted position where said plurality of nose sections are retracted toward said underwater vehicle to a deployed position where said plurality of nose sections extend outwardly from said underwater vehicle to form a generally rounded nose contour.

2. The deployable nose of claim 1 wherein said plurality of nose sections include:

a base nose section disposed at said one end of said underwater vehicle;

an outer nose section having a generally rounded contour;

at least one intermediate nose section having a tapered ring shape, said intermediate nose section being disposed between said outer nose section and said base nose section; and wherein said deployment mechanism is housed within said base nose section and joined to said outer nose section.

3. The deployable nose of claim 2 wherein said at least one intermediate nose section includes first and second intermediate nose sections, wherein, in said deployed position, said first intermediate nose section interlocks with said outer nose section and said second intermediate nose section interlocks with said base nose section and said first intermediate nose section.

4. The deployable nose of claim 1 wherein said deployment mechanism includes:

a threaded shaft;

a block threadably disposed on said shaft;

at least one arm coupled to an inner region of at least one of said plurality of nose sections and coupled to said block; and a motor coupled to said shaft for rotating said shaft, thereby causing said block to move along said shaft and causing said arm to move said at least one of said plurality of nose sections.

5. The deployable nose of claim 2 further comprising a plurality of retaining means with each said retaining means being joined between one said intermediate nose section and said one end of said underwater vehicle while said intermediate nose section is in said retracted position and separating when said intermediate nose section is deployed for preventing movement of said intermediate nose section in the retracted position.

6. The deployable nose of claim 5 further comprising an outer retaining means joined between said outer nose section and said one end of said underwater vehicle while said outer nose section is in said retracted position and separating when said outer nose section is deployed for preventing pivoting of said outer nose section in the retracted position.

7. The deployable-nose of claim 2 wherein said deployment mechanism comprises at least one linear actuator joined between said outer nose section and said one end of said underwater vehicle, said at least one linear actuator being retracted when said deployable nose is in said retracted position and said at least one linear actuator extending and moving said outer nose section outward into said deployed position.

8. The deployable nose of claim 7 wherein said at least one linear actuator comprises at least two linear actuators, each linear actuator having two ends and being pivotally attached to said outer nose section at a first end and pivotally attached to said one end of said underwater vehicle at a second end.

9. An underwater vehicle comprising:

a body portion;

a deployable nose at one end of said body portion; and said noise having a plurality of nose sections with interlocking edges; and a deployment mechanism disposed between said one end of said body portion and said deployable nose for moving said deployable nose from a retracted position to a deployed position, wherein said underwater vehicle has a shorter length when said deployable nose is in said retracted position, and wherein said underwater vehicle has reduced drag when said deployable nose is in said deployed position.

10. The underwater vehicle of claim 9 wherein said deployable said nose sections includes:

a base nose section disposed at one end of said body portion;

an outer nose section having a generally rounded contour; and at least one intermediate nose section having a tapered ring shape, said intermediate nose section being disposed between said outer nose section and said base nose section;

wherein said deployment mechanism moves said outer nose section from a retracted position where said outer nose section and said at least one intermediate nose section are retracted into said base nose section to a deployed position where said at least one intermediate nose section and said outer nose section fit together and extend outwardly from said base nose section.

11. The underwater vehicle of claim 10 wherein said at least one intermediate nose section includes first and second intermediate nose sections, wherein, in said deployed position, said first intermediate nose section interlocks with said outer nose section and said second intermediate nose section interlocks with said base nose section and said first intermediate nose section.

12. The underwater vehicle of claim 10 wherein said deployment mechanism includes:

a threaded shaft disposed within said base nose section;

a block threadably disposed on said shaft;

at least one arm coupled to an inner region of said outer nose section and coupled to said block; and a motor coupled to said shaft for rotating said shaft, thereby causing said block to move along said shaft and causing said arm to move said outer nose section.

13. The underwater vehicle of claim 10 further comprising a plurality of retaining means with each said retaining means being joined between one said intermediate nose section and said one end of said body portion while said intermediate nose section is in said retracted position and separating when said intermediate nose section is deployed for preventing movement of said intermediate nose section in the retracted position.

14. The underwater vehicle of claim 13 further comprising an outer retaining means joined between said outer nose section and said one end of said body portion while said outer nose section is in said retracted position and separating when said outer nose section is deployed for preventing pivoting of said outer nose section in the retracted position.

15. The underwater vehicle of claim 10 wherein said deployment mechanism comprises at least one linear actuator joined between said outer nose section and said one end of said body portion, said at least one linear actuator being retracted when said deployable nose is in said retracted position and said at least one linear actuator extending and moving said outer nose section outward into said deployed position.

16. The underwater vehicle of claim 15 wherein said at least one linear actuator comprises at least two linear actuators; each linear actuator having two ends and being pivotally attached to said outer nose section at a first end and pivotally attached to said one end of said body portion at a second end.

* * * * *